United States Patent [19]

Opitz

[11] 4,411,284

[45] Oct. 25, 1983

[54] WALKING AID TIP ASSEMBLY

[76] Inventor: Eric J. Opitz, 31280 Ramble Rd., Franklin Village, Franklin, Mich. 48025

[21] Appl. No.: 323,051

[22] Filed: Nov. 19, 1981

[51] Int. Cl.[3] ..... A45B 9/04

[52] U.S. Cl. ..... 135/81

[58] Field of Search ..... 135/81, 70, 77, 78, 135/79, 80, 86

[56] References Cited

U.S. PATENT DOCUMENTS

| | | | |
|---|---|---|---|
| 39,854 | 9/1863 | Wemple | 135/81 X |
| 415,511 | 11/1889 | Howgate | 135/81 |
| 1,197,375 | 9/1916 | Hoff | 135/86 X |
| 1,305,867 | 6/1919 | Atlas | 135/78 |
| 2,682,275 | 6/1954 | Eyrich | 135/70 |
| 3,040,757 | 6/1962 | Smith | 135/86 |
| 3,251,372 | 5/1966 | Smith | 135/86 |

FOREIGN PATENT DOCUMENTS

| | | | |
|---|---|---|---|
| 863678 | 2/1971 | Canada | 135/78 |
| 2433915 | 4/1980 | France | 135/78 |
| 120217 | 11/1947 | Sweden | 135/78 |

*Primary Examiner*—Robert A. Hafer
*Assistant Examiner*—Arnold W. Kramer
*Attorney, Agent, or Firm*—George A. Schmidt

[57] ABSTRACT

There is provided an improvement in the art of walking aid tip assemblies of the type that support an individual and provide assistance in ambulation or movement across ground surfaces of various conditions. This improvement includes the use of a spiked gripper member secured on the groundward end of the walking aid, a sleeve slidably and rotationally secured on the groundward end of the walking aid and selectively moveable relative thereto, and a flexible foot secured to the sleeve and engageable with the ground and having a series of annular grooves in the ground engaging surface thereof, the sleeve and foot being moveable axially relative to the gripper member to expose the gripper member to the ground in one position of operation, to separate the gripper member from the ground in another position of operation, and to expose both the gripper member and the foot to the ground in an intermediate position of operation.

1 Claim, 4 Drawing Figures

WALKING AID TIP ASSEMBLY

This invention relates to the art of walking aids for persons who need assistance in support or ambulation so that they can convey themselves or support themselves under various conditions. Such walking aids include canes, crutches, walkers and the like. The use of such devices has been well known to mankind for centuries, commonly taking the form of a staff, or a plurality thereof, upon which the user supports himself while standing or moving. In simplicity, the ground engaging end of such staff or staffs does no more than engage the ground and support the weight of the user. It is readily apparent that if the ground is firm, such supporting contact may be sufficient. Further, if firm ground contact can be maintained throughout the stride of the user, the user will have a feeling of safety and security. However, if the ground condition is only slightly less than firm, as out-of-doors in inclement weather, the ground engaging end of the device is most apt to slip or slide to the danger of the person using the walking aid.

There are many devices in the prior art that address themselves to these problems. Most such devices take the form of a button or tip that by the design of the contact area or choice of materials creates friction means for engaging the ground to prevent slipping or sliding. Other devices provide means that will positively penetrate the ground as the user manipulates the walking aid. Still others include a complex combination of various means, expensive to manufacture and produce and less than positive in their action to provide the intended benefits. Such devices are formed of a multiplicity of parts, difficult to manufacture, assemble, adjust, maneuver or operate, and are basically difficult or impractical to convert from "indoor" use to "outdoor" use without great effort and struggle by the user. These devices are not always positive in their positioning nor do they provide fail-safe means for preventing sliding or slipping in the case of adverse ground conditions. Unless the user can completely rely on his walking aid, the walking aid does not serve its intended purpose.

Others of the prior art devices attempt to solve only one of the problems inherent in the use of walking aids, that being the use of the device only in inclement conditions. A user must also have the availability of his device in "clement" conditions; that is, it is desirable for the aid to be useable indoors or outdoors and to be easily convertible between the two. Devices known in the art may assist the user in the "outdoors" problem, but be wholly unsafe and improper in use "indoors" on carpeting, polished floors, hard or soft surfaces, and the like. To simply provide a spike in the end of a cane for icy conditions would not do at all on a marble floor.

The device in which this invention is embodied provides a solution to the problems inherent in walking aids known in the prior art. Recognizing that walking aids in general may be of either tubular or solid construction, this device could either be incorporated into the manufacture of a walking aid or added to existing walking aids. It is proposed to provide a gripper member, or member having a plurality of sharp pointed projections, which can be positioned in the groundward end of the walking aid to engage the ground. Such member may be mounted inside the groundward end of the tubular device, or around the groundward end of the tubular construction, or around the groundward end of the solid construction. In any event, such member is fixed to the end of the walking aid so that as the user desires, the projections can engage the ice or difficult surface upon which it is being used. Surrounding the groundward end of the walking aid is a sleeve having secured thereto an annular flexible member, such sleeve and flexible member being moveable axially of the walking aid and being selectively securable in one of a number of different positions relative to the walking aid, axially as well as radially. By axial indexing, the gripper member may be fully exposed to the ground to provide "bite", or the gripper member may be fully retracted and separated from the ground. An intermediate position provides for simultaneous use of the gripper member and the flexible member. Indexing the sleeve and flexible member radially of the walking aid brings the least worn part of the total contact area into favorable ground contact. The flexible member, or foot, has a plurality of annular depressions in the ground engaging surface thereof, to provide positive engagement with the surface of the ground. Latching means are provided to hold the sleeve selectively in one of the desired positions; that is, either exposing the gripper member, separating the gripper member from the ground in its entirety, or a position in between. The latching means will permit complete removal of the sleeve and flexible member for purposes of maintenance or replacement.

A device so constructed is positive in its operation to permit the user to adjust to the vicissitudes of inclement ground conditions, and at the same time is readily adapted to convert the walking aid from indoor use to outdoor use when required. Thus, the user need only maintain one walking aid to carry him through all conditions of operation. As there is only one moving part, the construction is simple and economical. Manufacture and production costs are reduced to a minimum. More importantly, the user may rely on the fail-safe operation of the device and be assured that his companion will be suitable for him under all conditons of ambulation and support. The construction of the device lends itself readily to the conversion of already existing walking aids, or to be inherently manufactured as a part of new such aids. Maintenance of the walking aid structure is minimized, whether it be cleaning of the flexible foot and its annular rings, or sharpening of the spikes of the gripper member, all leading to a long life for the device.

These and other objects of the invention will become more apparent from the following description and drawing in which.

Figure 2:
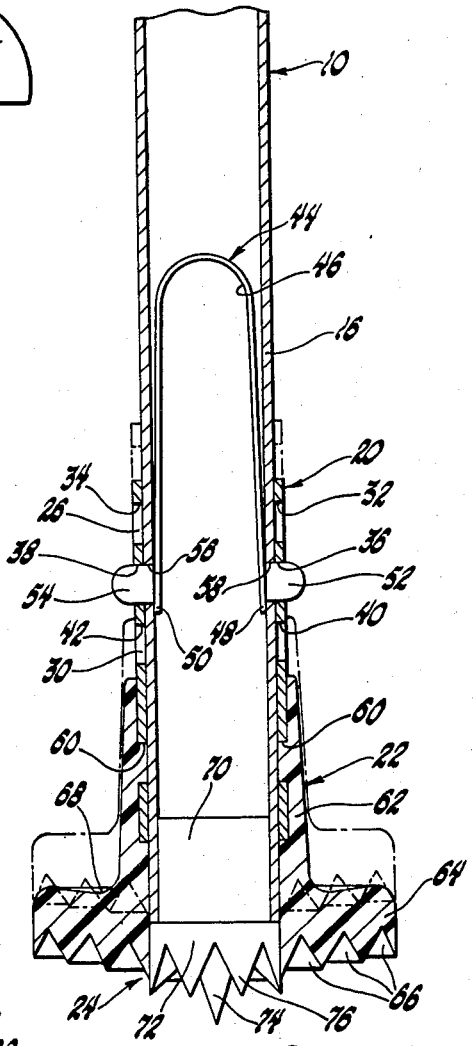
FIG. 2 is an enlarged cross-sectional view of a portion of the device shown in FIG. 1, showing the assembly mounted on the groundward end of the walking aid and showing in dashed and dotted lines a second position of the parts.
Figure 3:
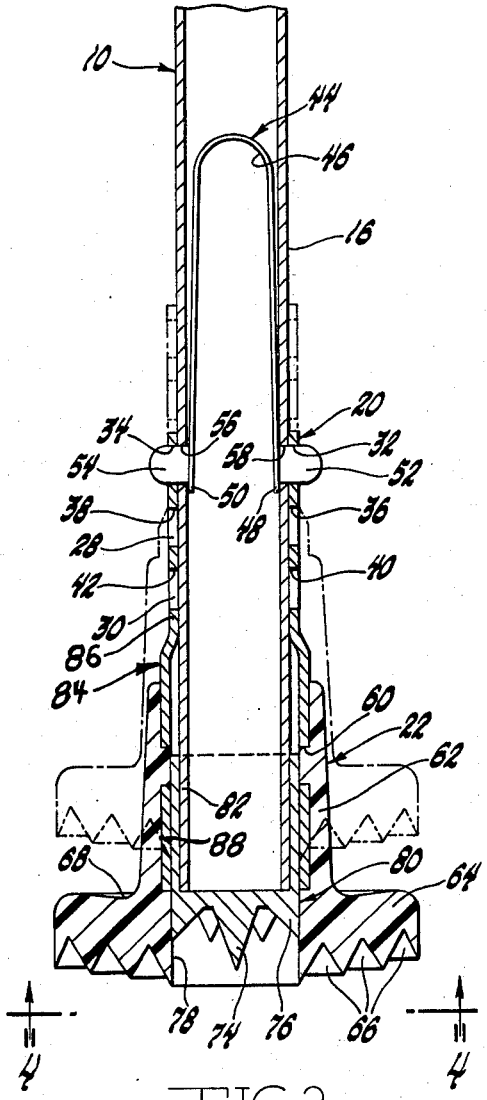
FIG. 3 is an enlarged cross-sectional view of a portion of the device shown in FIG. 1 and illustrating a modification of the device in FIG. 2 in which the gripper member is mounted around the groundward end of the walking aid, and further showing in dashed and dotted lines a third position of the parts.
Figure 4:
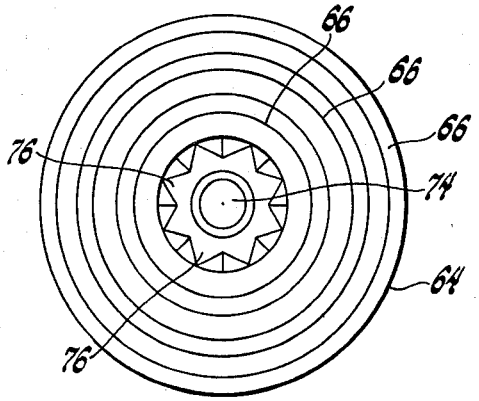

and FIG. 4 is an end view of the device of FIGS. 2 and 3, taken along the line 4—4 of FIG. 3 and looking in the direction of the arrows, showing the annular rings of the flexible member and the spike means of the gripper member.

Figure 1:
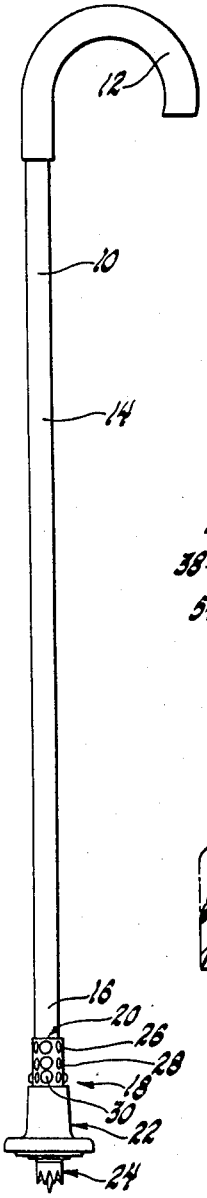
FIG. 1 is a general view of a walking aid, in this case a cane, with the device of this invention installed on the groundward end thereof and with the gripper member in its extended position.

Referring more particularly to the drawing, where the various embodiments and figures are representative of the invention only, and not intended to limit the invention thereby, FIG. 1 illustrates a typical walking aid device, generally recognized as a cane 10. It is to be understood at the outset that any type of walking or support aid, such as cane, crutch or walker, or any other device commonly used to support the weight or to assist in the ambulation of the user, can equally be equipped with the assembly of the invention. Thus, for example purposes only, cane 10 is shown, and which includes an upward handle 12, a tubular body 14 and a groundward end 16. Groundward end 16 has mounted thereon the assembly of this invention, indicated generally by the numeral 18.

Device 18 includes a generally cylindrical sleeve member, indicated generally by the numeral 20, which is concentrically and slidably mounted, as will be hereinafter more particularly described, on the groundward end 16 of the cane 10. A flexible foot member, indicated generally by the numeral 22 is secured to the sleeve 20 and is moveable therewith. A gripper member, indicated generally by the numeral 24, is secured in or around the groundward end of the cane 10 in a manner to be hereinafter described.

Referring next to FIG. 2, sleeve member 20 is shown to be of cylindrical construction and has an inner diameter for sliding fit around the groundward end 16 of the cane 10. Sleeve 20 is provided with three annular series of holes 26, 28 and 30 which receive the latching means which will be hereinafter more particularly described. Each of the annular series of holes include diametrically opposed holes, such as holes 32 and 34 in the upper annulus 26, or holes 36 and 38 in the middle annulus 28, and holes 40 and 42 in the lower annulus 30.

Received in the tubular lower shaft 16 of the cane 10 is a latching means, indicated generally by the numeral 44. Means 44 includes a U shaped spring member 46 having outwardly biased ends 48 and 50. Fixedly secured on the ends 48 and 50 are buttons 52 and 54 which are passed through holes 56 and 58 provided in the tubular portion 16. Buttons 52 and 54 are received through one set of holes, as holes 36 and 38 in the middle annulus of holes 28 in the sleeve member 20. As can be observed, with the buttons 52 and 54 positioned through the holes 56 and 58 in the tubular portion 16 and the holes 36 and 38 in the sleeve 20, the sleeve member 20 will be securely locked in both axial and rotational position relative to the groundward end 16 of the cane 10. By depressing the buttons 52 and 54 of the latching means against the bias of the spring 46, the sleeve member 20 can be released to slide axially of the cane shaft 16 and the buttons 52 and 54 reengaged in another pair of holes, as 32 and 34 in the upper annulus 26, thus fixing the sleeve 20 in another fixed position relative to the end of the cane portion 16. Since the holes are in annular location, the sleeve member 20 may also be moved rotationally relative to the cane portion 16 for purposes to become herienafter more apparent.

Secured to the sleeve member 20 is the flexible foot member, indicated generally by the numeral 22. Securement may be in any manner well known in the prior art, such as molding the flexible foot structure directly to the outer diameter of the sleeve 20, holes 60 being formed in the sleeve 20 to lock the flexible foot 22 therein upon manufacture. Foot member 22 includes a generally cylindrical portion 62, received about the sleeve 20, terminating at its lower end in an axially outwardly extending flange 64. In the undersurface of flange 64 are a series of annular grooves 66 for best contact of the undersurface of the flange 64 with the ground, as will become hereinafter more apparent.

Flexible foot 22 is formed of a plastic material and is provided with an annular depression 68 at the outer junction of the cylndrical portion 62 and the flange 64. Such depression 68 provides a concentric zone at which flexing will occur as the user manipulates the cane 10. That is, as the user moves the cane structure 10, the outer edge of the flange 64 will first contact the ground surface and at an angle relative thereto. As the cane 10 is rotated forwardly by the user in normal ambulation, the flexure about the flexing zone 68 will maintain a maximum foot to ground contact for best operation of the device. Proper flexure for physical characteristics of the user can be varied by changing the pliability of the material from which the flexible foot 22 is manufactured.

Since the flexible foot 22 will be in contact with the ground under some conditions of operation, and the condition of the ground may be dirty or slushy, it is desirable that the cross-section of the grooves 66 be at substantially a right angle. Such construction provides a self cleaning action as the foot is manipulated under normal usage.

Secured in the end 16 of the cane 10 is the gripper member, indicated generally by the numeral 24. Gripper member 24 has an upward cylindrical end 70 which is removeably but securely mounted in the tubular end 16. Such securement may be a force fit or friction fit, it being important that the member 22 be retained in the tubular end 16 unless forcebly removed. The lower end 72 of the gripper member 24 includes a central pointed spike 74 and a plurality of outer spikes 76 of less axial protrusion. Spikes 76 are so formed that simple machining operations, well known in the art, will form such spikes and, having been formed, can be simply resharpened if ever desired. It can be noted that the lower portion 72 of the gripper member is received within the central bore 78 of the flexible foot 22. It is intended that the fit between the gripper portion 72 and the bore 78 be such that the lower end of the foot member 22 adjacent the gripper portion 72 will seal the surfaces and the interior of the tubular portion 16 against the entry of moisture or other foreign materials. This may be accomplished by a judicious selection of diameters of the bore 78 and the gripper portion 72.

With reference next to FIG. 3, where like reference numerals relate to like parts, a modification of the device is shown wherein the gripper member, indicated generally by the numeral 80, is shown to include a tubular upper portion 82 to be secured around the outside of the groundward end 16 of the cane 10. Such mounting permits adaptation of the device to another diameter or construction of walking aid 10. The gripper member 80 is provided with the central spike 74 and the annulus of surrounding spikes 76 in the same manner as hereinbefore described.

To accommodate the tubular portion 82 of the gripper member 80, a sleeve member, indicated generally by the numeral 84, is formed to have an upper cylindrical portion 86 provided with the annular series of holes 26, 28 and 30 as hereinbefore described. The inner diameter of the portion 86 is sized for snug fit about the groundward end 16 of the cane 10, and to allow axial and rotational movement thereabout. The lower portion 88 of the sleeve 84 is of enlarged cylindrical form to be received about and to axially and rotationally slide relative to the gripper member 80. The lower portion 88 has secured thereto the flexible foot member 22 as previously described.

As has been indicated, the sleeve member 20 and flexible foot 22 of FIG. 2 are selectively axially moveable relative to the groundward end 16 of the walking aid 10. To describe the operation of the device, it is first to be assumed that the ground conditions confronting the user of the device are of ice and snow, and such that a normal walking aid would slip or slide as the user places his weight thereon. Under such conditions, the sleeve 20 and the foot 22 would be selectively placed with the buttons 52 and 54 extending outwardly through diametrically opposed holes 40 and 42 in the lower annulus of holes 30. Such position is as shown in FIG. 1. Thus, the sleeve 20 and foot 22 would be withdrawn axially upwardly of the end 16 of the cane 10, exposing the gripper member 24 and its spikes 74 and 76 to the ground ice. As the user ambulates, the cane is tilted and it will be noted that at all times spike 74 and some of spikes 76 will penetrate the surface of the ice or the icey ground. Therefore, secure and positive contact is made and maintained for the safety of the user.

Let it next be assumed that the ground conditions are merely slushly or soft, or a combination of ice and slush. The sleeve 20 and foot 22 would then be indexed manually by the user, depressing the buttons 52 and 54 inwardly to free them from the lower annulus of holes 30, and the sleeve 20 moved axially downwardly until the buttons 52 and 54 snap outwardly through diametrically opposed holes 32 and 34 in the middle annulus of holes 28. Such is the position shown in full lines in FIG. 2. Thus, not only is the spike 74 and some of the spikes 76 of the gripper member 24 exposed to the ground surface, but so also is the lower surface of the flange 64 of the foot 22 and the annular grooves 66. The dual contact provided makes safe the ambulation of the user in a positive and secure manner. Again as the walking aid tilts with the normal movement of the user, the flange 64 of the foot 22 flexes about the concentric zone 68 to increase the degree of contact of the flange 64 with the ground at the area of contact.

Finally, let it be assumed that the ground surface to be encountered is a smooth floor or pavement. Once again, the user manually depresses the buttons 52 and 54 and slides the sleeve 20 axially downwardly until the buttons 52 and 54 snap outwardly through the holes 32 and 34 in the upper annulus of holes 26. By so doing, the sleeve 20 and foot 22 completely enclose the gripper member 24 to keep it from contact with the ground surface. The lower surface of the foot flange 64 and the grooves 66 provide sure and secure contact with the ground surface and safe contact for the user.

By providing an annulus of holes, as annulus 28, it will now be apparent that should any portion of the flexible foot 22 wear with use, the sleeve 20 and foot 22 may be indexed rotationally about the portion 16 of the cane 10, so that a different and rotationally spaced pair of diametrically opposed holes in the annulus can be engaged by the buttons 52 and 54. Consequently, a different portion of the under surface of the foot flange 64 will engage the ground. Should wear occur in the spikes 74 or 76 of the gripper member 24, the gripper member may be removed from the portion 16 of the cane 10 by any suitable tool or means for resharpening as hereinbefore mentioned. Thus, the device can be of long lasting duration with a minimum of replacement of parts and expense relative thereto. Further, such adjustment readily compensates for wear caused by the particular stride or walking habits of the user of the device.

Thus, a device is provided that simply and efficiently solves the various problems inherent in devices past known in the art of walking aids. The device provided gives sure, positive and fail-safe connection between the groundward end of a walking aid and the ground under all conditions of operation. An infirm user of the device may comfortably rely on the device to carry out its purpose, and not be inhibited in his movements because of the lack of safety. The device is of simple construction, has only one moving part, or combination of parts, and is simply operated by the user to change from one ground condition to another. Maintenance is kept at a minimum, whether simple cleaning, compensation for wear or resharpening. Compensation for particularities of the user, such as stride, walking habits, degree of support required, and the like is readily handled. The user may rely on a single walking aid device to provide his support or assist in ambulation, regardless of the variations in ground surface he may encounter.

The present invention has been described in connection with various embodiments thereof. However it is to be appreciated that various changes may be made in such embodiments without departing from the scope and spirit of the invention as defined in the appended claims.

Having thus described the invention, I claim:

1. An attachment for the groundward end of a walking aid comprising:

a ground-engaging member fixedly secured in said groundward end of said walking aid and having a spike extending in the groundward direction therefrom;

a sleeve slidably secured about said groundward end of said walking aid and axially moveable relative thereto, said sleeve having three annuli of holes spaced therealong;

a resilient foot securely mounted on said sleeve and below said annuli of holes, said foot having an outwardly projecting annular flange at the groundward end thereof and having a ground engaging surface at the groundward end of said flange, said surface having a plurality of annular grooves therein;

and latch means in said walking aid and selectively engageable with holes in one of said annuli of holes to secure said sleeve and said foot in one position relative to said walking aid and said ground engaging member to permit engagement of said spike on said ground engaging member with the ground and separate said ground engaging surface of said foot from the ground, said latch means being selectively moveable to engage holes in another annuli of holes in said sleeve to secured said sleeve relative to said groundward end of said walking aid and said spike on said ground engaging member in a second position separating said spike from the ground and engaging said ground engaging surface of said foot with the ground, and said latch means being selectively moveable to engage holes in another of said annuli of holes in said sleeve to secure said sleeve relative to the groundward end of said walking aid and said ground engaging member in a third position engaging both said spike and said ground engaging surface of said foot with the ground, said annuli of holes additionally permitting said sleeve and foot in any of said three positions to be rotationally indexed so as to compensate for wear on any given portion of the ground engaging surface of said foot.

* * * * *